US009528065B2

(12) United States Patent
Kaneko et al.

(10) Patent No.: US 9,528,065 B2
(45) Date of Patent: Dec. 27, 2016

(54) COAL DEACTIVATION PROCESSING DEVICE AND EQUIPMENT FOR PRODUCING MODIFIED COAL USING SAME

(71) Applicant: MITSUBISHI HEAVY INDUSTRIES, LTD., Tokyo (JP)

(72) Inventors: Takeshi Kaneko, Tokyo (JP); Kenji Atarashiya, Tokyo (JP); Keiichi Nakagawa, Tokyo (JP); Setsuo Omoto, Tokyo (JP); Tsutomu Hamada, Tokyo (JP)

(73) Assignee: MITSUBISHI HEAVY INDUSTRIES, LTD., Minato-ku, Tokyo (JP)

( * ) Notice: Subject to any disclaimer, the term of this patent is extended or adjusted under 35 U.S.C. 154(b) by 0 days.

(21) Appl. No.: 14/408,769

(22) PCT Filed: Oct. 25, 2013

(86) PCT No.: PCT/JP2013/078905

§ 371 (c)(1),
(2) Date: Dec. 17, 2014

(87) PCT Pub. No.: WO2014/091827

PCT Pub. Date: Jun. 19, 2014

(65) Prior Publication Data

US 2015/0329793 A1 Nov. 19, 2015

(30) Foreign Application Priority Data

Dec. 14, 2012 (JP) ..... 2012-273339

(51) Int. Cl.
*C10L 9/00* (2006.01)
*C10L 9/06* (2006.01)
(Continued)

(52) U.S. Cl.
CPC .. *C10L 9/06* (2013.01); *C10L 5/04* (2013.01); *C10L 9/08* (2013.01); *C10L 2290/02* (2013.01);
(Continued)

(58) Field of Classification Search
CPC ..... C10L 9/06; C10L 9/08; C10L 5/04; C10L 2290/60; C10L 2290/58; C10L 9/083; C10L 2290/08; C10L 2290/02
See application file for complete search history.

(56) References Cited

U.S. PATENT DOCUMENTS 4,199,325 A 4/1980 Smith
4,401,436 A * 8/1983 Bonnecaze ..... C10L 5/00 34/393
(Continued)

FOREIGN PATENT DOCUMENTS

AF 59-74189 A 4/1984
CN 1235630 A 11/1999
(Continued)

OTHER PUBLICATIONS

Extended (supplementary) European Search Report dated Jul. 12, 2016, issued in counterpart European Patent Application No. 13862453.1. (7 pages).
(Continued)

*Primary Examiner* — Cephia D Toomer
(74) *Attorney, Agent, or Firm* — Westerman, Hattori, Daniels & Adrian, LLP

(57) ABSTRACT

Provided is a coal deactivation processing device that can suppress an increase in carbon monoxide concentration in processing gas regardless of the fact that used processing gas is circulated and refused. The present invention is provided with: a device main body (141) that causes coal therewithin to flow from one side to another; a processing gas feed
(Continued)

means (142-144, 144*a*, 145, 145*a*, 146, 146*a*, 147, 148) that feeds processing gas to the interior of the device main body (141); a processing gas circulation means (148) that circulates used processing gas (33) used in the device main body (141) to the processing gas feed means; and a carbon monoxide processing device (170) that adjusts the carbon monoxide concentration in the processing gas in a manner so as to reduce the carbon monoxide concentration in the processing gas.

6 Claims, 8 Drawing Sheets

(51) Int. Cl.
*C10L 9/08* (2006.01)
*C10L 5/04* (2006.01)

(52) U.S. Cl.
CPC ..... *C10L 2290/08* (2013.01); *C10L 2290/58* (2013.01)

(56) References Cited

U.S. PATENT DOCUMENTS

| | | | |
|---|---|---|---|
| 4,645,513 | A | 2/1987 | Kubota et al. |
| 5,601,692 | A | 2/1997 | Rinker et al. |
| 5,711,769 | A | 1/1998 | Rinker et al. |
| 5,840,651 | A | 11/1998 | Hanashita et al. |
| 6,436,158 | B1 | 8/2002 | Fujisawa et al. |
| 9,290,711 | B2 * | 3/2016 | Sato ..... C10B 57/08 |

FOREIGN PATENT DOCUMENTS

| | | | |
|---|---|---|---|
| JP | 63-67518 | B2 | 12/1988 |
| JP | 11-310785 | A | 11/1999 |
| JP | 2007-237011 | A | 9/2007 |
| JP | 2012-126856 | A | 7/2012 |
| JP | 2013-139536 | A | 7/2013 |
| WO | 95/13868 | A1 | 5/1995 |
| WO | 2011/008817 | A2 | 1/2011 |
| WO | 2012/081371 | A1 | 6/2012 |

OTHER PUBLICATIONS

Office Action dated Dec. 18, 2015, issued in Chinese Patent Application No. 201380032598.6, with English Translation (15 pages).

International Search Report dated Dec. 10, 2013, issued in counterpart International Application No. PCT/JP2013/078905 (2 pages).

Notification of Transmittal of Translation of the International Preliminary Report on Patentability (Form PCT/IB/338) issued in counterpart International Application No. PCT/JP2013/078905 mailed Jun. 25, 2015 with Forms PCT/IB/373 and PCT/ISA/237 (9 pages).

* cited by examiner

COAL DEACTIVATION PROCESSING DEVICE AND EQUIPMENT FOR PRODUCING MODIFIED COAL USING SAME

TECHNICAL FIELD

The present invention relates to a coal deactivation processing device and upgraded coal production equipment using the same.

BACKGROUND ART

Since low-rank coal (low-quality coal) containing a large amount of water such as brown coal and subbituminous coal has a low heating value per unit weight, the low-rank coal is heated to be dried and pyrolized and is also upgraded in a low oxygen atmosphere to reduce surface activity. The low-rank coal is thereby turned into upgraded coal which has an improved heating value per unit weight while being prevented from spontaneously combusting.

PRIOR ART DOCUMENT

Patent Document

Patent Document 1: Japanese Patent Application Publication No. 2007-237011

Patent Document 2: International Patent Application Publication No. WO95/13868

SUMMARY OF THE INVENTION

Problems to be Solved by the Invention

Various types of coal deactivation processing devices configured to deactivate the aforementioned pyrolized coal produced by drying and pyrolizing the low-rank coal have been studied. For example, as shown in FIG. 8, there is a device in which processing gas containing a low concentration of oxygen is circulated. This device 500 includes a processing tower 501 in which coal 521 being the pyrolized coal flows from an upper side being one side to a lower side being another side. Front end sides of multiple introduction pipes 511 configured to introduce processing gas 533 containing a low concentration of oxygen into the processing tower 501 and base end sides of multiple discharge pipes 512 configured to discharge processing gas 534 flowing inside the processing tower 501 to the outside are connected to the processing tower 501 in a manner arranged in a up-down direction. A front end side of a feed pipe 513 configured to feed the processing gas 533 is connected to base end sides of the introduction pipes 511.

A front end side of an air supply pipe 514 configured to supply air 531 and a front end side of a nitrogen supply pipe 515 configured to supply nitrogen gas 532 are connected to a base end side of the feed pipe 513. A base end side of the nitrogen supply pipe 515 is connected to a nitrogen supply source 516 such as a nitrogen gas tank. A base end side of the air supply pipe 514 is opened to the atmosphere. A flow-rate regulating valve 514*a* is provided in the middle of the air supply pipe 514, and a flow-rate regulating valve 515*a* is provided in the middle of the nitrogen supply pipe 515. A blower 513*a* is provided in the middle of the feed pipe 513. A humidity-temperature adjustment device 513*b* configured to adjust the humidity and temperature of the processing gas 533 is provided between the front end side of the feed pipe 513 and the blower 513*a*. A base end side of a branch pipe 518 configured to discharge the processing gas 533 to the outside of the system is connected to the feed pipe 513 between the blower 513*a* and the humidity-temperature adjustment device 513*b*. A base end side of a circulation pipe 517 is connected to front end sides of the discharge pipes 512. A front end side of the circulation pipe 517 is connected to the base end side of the feed pipe 513.

In the coal deactivation processing device 500, the pyrolized coal 521 is supplied into the processing tower 501 from above. Moreover, the air 531 and the nitrogen gas 532 are fed from the supply pipes 514, 515 to the feed pipe 513 by controlling opening degrees of the flow-rate regulating valves 514*a*, 515*a* and an operation of the blower 513*a* and are mixed to produce the processing gas 533, and the humidity and temperature of the processing gas 533 are adjusted by controlling an operation of the humidity-temperature adjustment device 513*b*. The processing gas 533 whose humidity and temperature are adjusted as described above is introduced into the processing tower 501 through the introduction pipes 511 and used to deactivate a surface of the coal 521 in the processing tower 501. Then, the processing gas 533 is discharged from the discharge pipes 512 to the circulation pipe 517 as used processing gas 534. The used processing gas 534 discharged to the circulation pipe 517 is returned to the feed pipe 513 and is mixed with the new air 531 and nitrogen gas 532 from the supply pipes 514, 515 to be reused as the new processing gas 533. At this time, the same amount of the processing gas 533 as the air 531 and the nitrogen gas 532 supplied from the supply pipes 514, 515 is discharged to the outside of the system from the branch pipe 518.

In the processing tower 501, the coal 521 reacts with oxygen in the processing gas 533 and small amounts of carbon monoxide and carbon dioxide are generated. Since the used processing gas 534 used in the deactivation processing of the coal 521 in the processing tower 501 is sent to the feed pipe 513 via the discharge pipes 512 and the circulation pipe 517, the carbon monoxide concentration in the processing gas 533 increases with elapse of operation time, in proportion to the operation time.

Since carbon monoxide has a great effect on human body depending on its concentration, the concentration of carbon monoxide is required to be reduced in a plant and the like in which the coal deactivation processing device 500 is installed.

In view of this, the present invention has been made to solve the problems described above and an object thereof is to provide a coal deactivation processing device and upgraded coal production equipment using the same which can suppress an increase of the carbon monoxide concentration in processing gas despite of circulating and reusing the used processing gas.

Means for Solving the Problems

A coal deactivation processing device of a first aspect of the invention for solving the problems described above is a coal deactivation processing device configured to deactivate coal with processing gas containing oxygen, characterized in that the coal deactivation processing device comprises: a device main body in which the coal flows from one side to another side; processing gas feeding means for feeding the processing gas into the device main body; processing gas circulating means for circulating used processing gas used in the device main body to the processing gas feeding means; and carbon monoxide processing means for adjusting a carbon monoxide concentration in the processing gas such that the carbon monoxide concentration in the processing gas is reduced.

A coal deactivation processing device of a second aspect of the invention for solving the problems described above is the coal deactivation processing device of the first aspect of the invention, characterized in that the carbon monoxide processing means includes: processing gas extracting means for extracting the processing gas; oxidizing means for oxidizing carbon monoxide in the processing gas extracted by the processing gas extracting means and adjusting the carbon monoxide concentration in the processing gas; and carbon monoxide adjusted processing gas feeding means for feeding the processing gas whose carbon monoxide concentration is adjusted by the oxidizing means to the processing gas feeding means or the processing gas circulating means.

A coal deactivation processing device of a third aspect of the invention for solving the problems described above is the coal deactivation processing device of the second aspect of the invention, characterized in that the oxidizing means is any one of an oxidation catalyst configured to oxidize carbon monoxide in the processing gas, a combustion furnace configured to combust the processing gas together with supplied fuel, and a regenerative thermal oxidizer configured to combust the processing gas together with supplied fuel.

A coal deactivation processing device of a fourth aspect of the invention for solving the problems described above is the coal deactivation processing device of the second aspect of the invention, characterized in that the coal deactivation processing device further comprises: extraction amount regulating means for regulating an extraction amount by which the processing gas extracting means extracts the processing gas; processing gas state detecting means for detecting the carbon monoxide concentration of the processing gas flowing in the processing gas feeding means or the processing gas circulating means; and control means for controlling the extraction amount regulating means on the basis of the carbon monoxide concentration of the processing gas detected by the processing gas state detecting means.

A coal deactivation processing device of a fifth aspect of the invention for solving the problems described above is the coal deactivation processing device of the fourth aspect of the invention, characterized in that the control means: controls the extraction amount regulating means such that the processing gas is extracted by the extracting means when the carbon monoxide concentration of the processing gas detected by the processing gas state detecting means is equal to or greater than an upper limit value; and controls the extraction amount regulating means such that no processing gas is extracted by the extracting means when the carbon monoxide concentration of the processing gas detected by the processing gas state detecting means is equal to or less than a lower limit value less than the upper limit value.

Upgraded coal production equipment of a sixth aspect of the invention for solving the problems described above is characterized in that the upgraded coal production equipment comprises: coal drying means for drying coal; coal pyrolizing means for pyrolizing dry coal dried by the coal drying means; pyrolized coal cooling means for cooling pyrolized coal pyrolized by the coal pyrolizing means; and the coal deactivation processing device of the first aspect of the invention which performs deactivation processing on the pyrolized coal cooled by the coal cooling means.

Upgraded coal production equipment of a seventh aspect of the invention for solving the problems described above is characterized in that the upgraded coal production equipment comprises: coal drying means for drying coal; coal pyrolizing means for pyrolizing dry coal dried by the coal drying means; pyrolized coal cooling means for cooling pyrolized coal pyrolized by the coal pyrolizing means; and the coal deactivation processing device of the third aspect of the invention which performs deactivation processing on the pyrolized coal cooled by the coal cooling means, the coal pyrolizing means includes an inner tube to which the coal is supplied, an outer tube which is provided to cover the inner tube and into which heating gas is supplied to indirectly heat the inner tube, and pyrolysis gas discharging means for discharging pyrolysis gas generated by heating the coal in the inner tube, and the upgraded coal production equipment further comprises fuel feeding means for feeding the pyrolysis gas discharged by the pyrolysis gas discharging means to the combustion furnace or the regenerative thermal oxidizer.

Effect of the Invention

The coal deactivation processing devices and the upgraded coal production equipments using the same in the present invention each includes the carbon monoxide processing means for adjusting the carbon monoxide concentration in the processing gas such that the carbon monoxide concentration in the processing gas is reduced. Accordingly, even when the processing gas used in the device main body is returned to the processing gas feeding means by the processing gas circulating means, it is possible to suppress an increase of the carbon monoxide concentration in the processing gas to be fed into the processing device main body by the processing gas feeding means. Due to this, even when the coal deactivation processing device is installed in a building which is a closed space, the increase of the carbon monoxide concentration in the building can be suppressed. Hence, a safe environment can be maintained even in the building.

MODE FOR CARRYING OUT THE INVENTION

Embodiments of a coal deactivation processing device and upgraded coal production equipment using the same in the present invention are described based on the drawings.

However, the present invention is not limited to the embodiments described below based on the drawings.

First Embodiment

Figure 1:
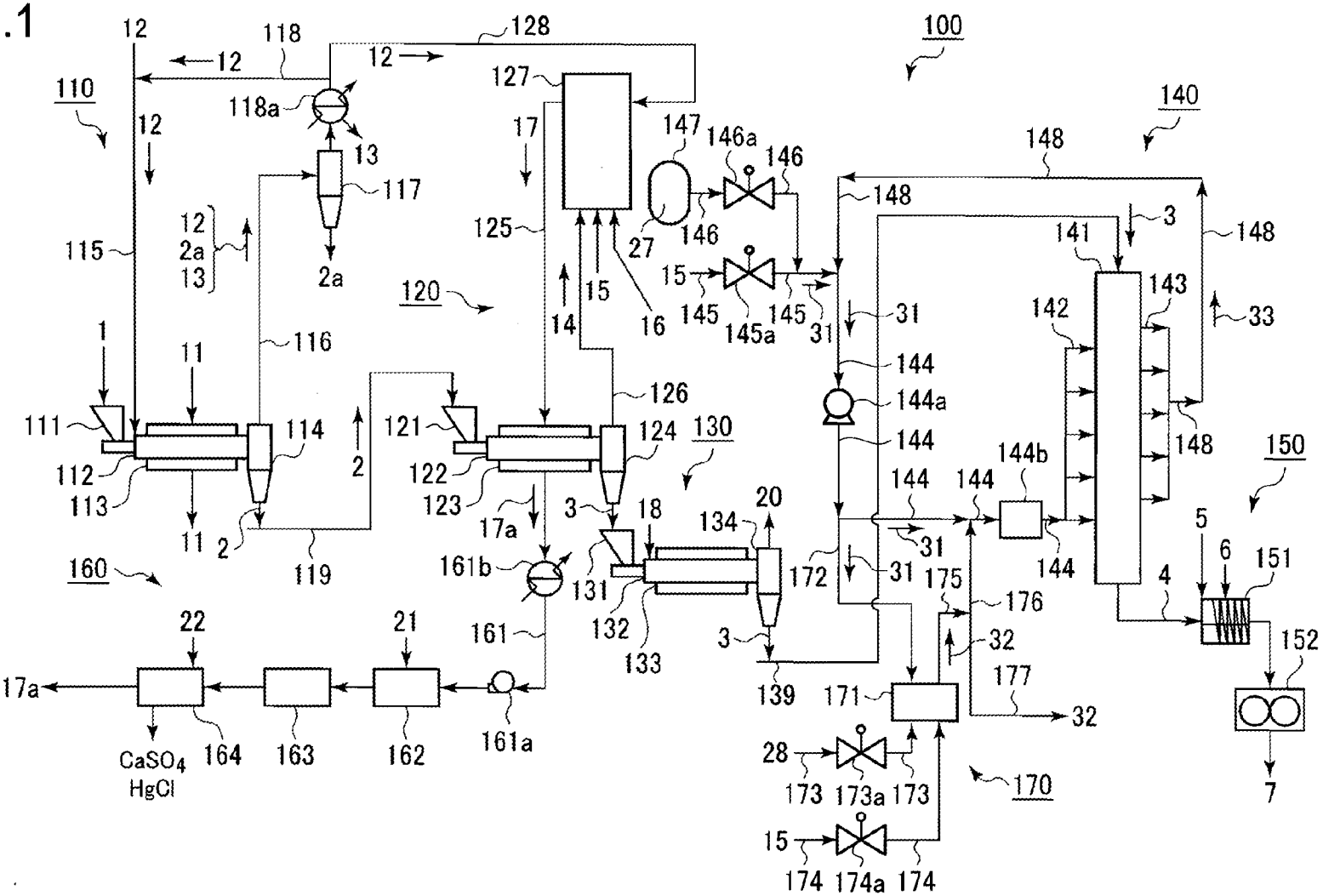
FIG. 1 is a schematic configuration diagram of a first embodiment of upgraded coal production equipment in the present invention.
Figure 2:
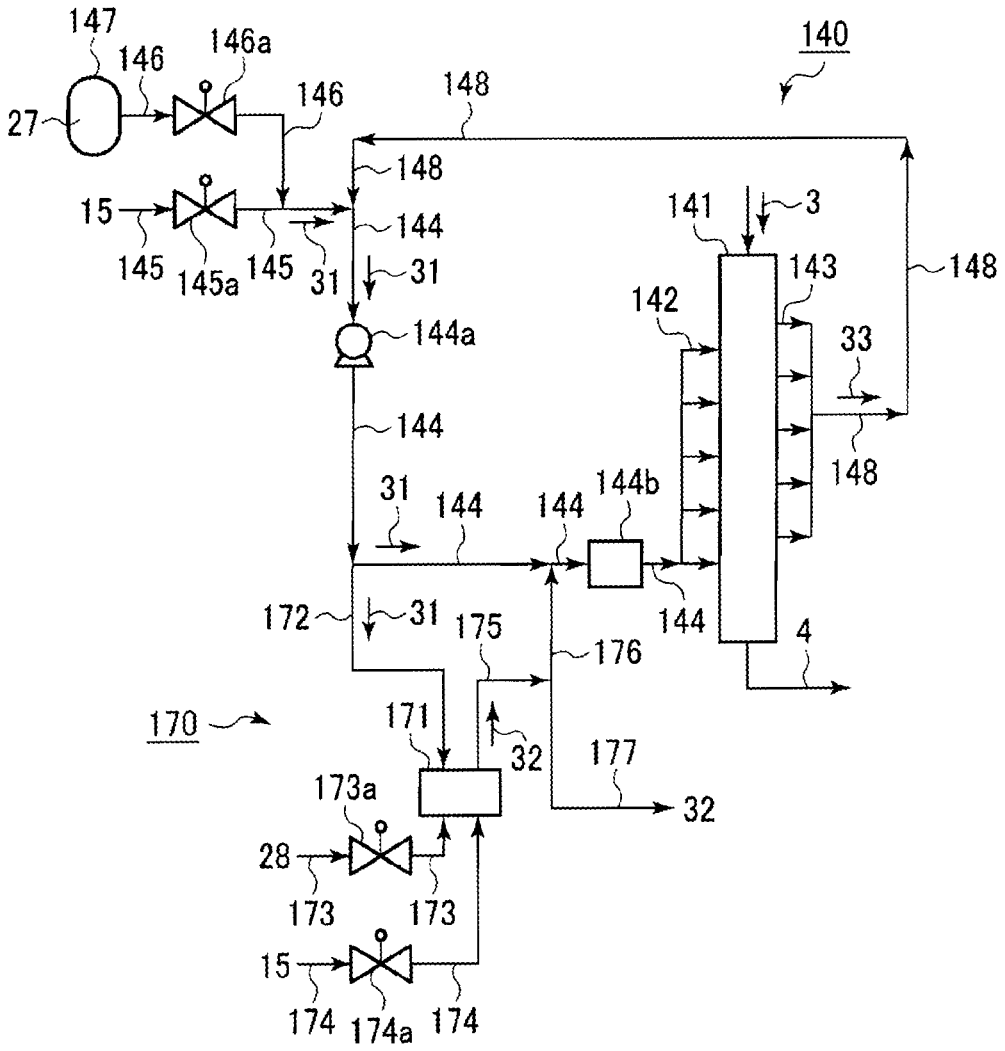
FIG. 2 is a schematic configuration diagram of a main portion of a coal deactivation device in FIG. 1.

A first embodiment of the coal deactivation processing device and the upgraded coal production equipment using the same in the present invention is described based on FIGS. 1 and 2.

As shown in FIG. 1, a coal drying device 110 which is coal drying means for drying low-rank coal (low-quality coal) 1 being coal containing a large amount of water such as brown coal and subbituminous coal includes: a hopper 111 which receives the low-rank coal 1; a rotatably-supported inner tube (main body cylinder) 112 into which the low-rank coal 1 in the hopper 111 is supplied from one end side (base end side); an outer tube (jacket) 113 which is fixedly supported to cover an outer peripheral surface of the inner tube 112 while allowing the inner tube 112 to rotate and which is configured such that steam 11 being a heating medium is supplied to an inside of the outer tube 113 (space between the outer tube 113 and the inner tube 112); and a chute 114 which is connected to the other end side (front end side) of the inner tube 112 to allow the inner tube 112 to rotate and which sends out dry coal 2 by causing the dry coal 2 to fall from the other end side (front end side) of the inner tube 112.

A front end side of an inert gas feed line 115 through which inert gas 12 such as nitrogen gas is fed is connected to the one end side (base end side) of the inner tube 112 of the coal drying device 110. One end side of an exhaust line 116 for exhausting the inert gas 12 containing carbon monoxide, water vapor, and the like is connected to an upper portion of the chute 114. The other end side of the exhaust line 116 is connected to a cyclone separator 117 which separates and collects fine coal 2*a* from the inert gas 12, the fine coal 2*a* generated in the drying of the low-rank coal 1.

One end side (base end side) of a circulation line 118 including a condenser 118*a* is connected to the cyclone separator 117, the condenser 118*a* configured to separate and remove the water vapor from the inert gas 12, from which the fine coal 2*a* is separated, by causing the water vapor in the inert gas 12 to condense into water 13. The other end side (front end side) of the circulation line 118 is connected to the middle of the inert gas feed line 115.

A lower portion of the chute 114 of the coal drying device 110 communicates with an upstream side, in a conveying direction, of a dry coal conveying line 119 such as a belt conveyor configured to convey the dry coal 2 sent out from the chute 114. A downstream side of the dry coal conveying line 119 in the conveying direction communicates with a coal pyrolizing device 120 configured to pyrolyze the dry coal 2.

The coal pyrolizing device 120 includes: a hopper 121 which receives the dry coal 2 from the dry coal conveying line 119; a rotatably-supported inner tube (main body cylinder) 122 into which the dry coal 2 in the hopper 121 is supplied from one end side (base end side); an outer tube (jacket) 123 which is fixedly supported to cover an outer peripheral surface of the inner tube 122 while allowing the inner tube 122 to rotate and which is configured such that heating gas 17 being a heating medium is supplied to an inside of the outer tube 123 (space between the outer tube 123 and the inner tube 122); and a chute 124 which is connected to the other end side (front end side) of the inner tube 122 to allow the inner tube 122 to rotate and which sends out pyrolized coal 3 by causing the pyrolized coal 3 to fall from the other end side (front end side) of the inner tube 122.

One end side (base end side) of an exhaust line 126 for discharging pyrolysis gas (heat decomposition gas) 14 such as carbon monoxide, water vapor, and tar is connected to an upper portion of the chute 124 of the coal pyrolizing device 120. The other end side (front end side) of the exhaust line 126 is connected to a combustion furnace 127 to which air 15 and a combustion aid 16 are supplied.

A take-out line 128 for taking out part of the inert gas 12 from the circulation line 118 of the coal drying device 110 and supplying the inert gas 12 into the combustion furnace 127 is connected to the combustion furnace 127, the inert gas 12 being subjected to the removal of the water 13 in the circulation line 118. One end side (base end side) of a heating gas feed line 125 for feeding the heating gas 17 generated in the combustion furnace 127 is connected to the combustion furnace 127. The other end side (front end side) of the heating gas feed line 125 communicates with the inside of the outer tube 123.

A lower portion of the chute 124 of the coal pyrolizing device 120 communicates with a cooling device 130 which is pyrolized coal cooling means for cooling the pyrolized coal 3 sent out from the chute 124. The cooling device 130 includes: a hopper 131 which receives the pyrolized coal 3 from the chute 124 of the coal pyrolizing device 120; a rotatably-supported inner tube (main body cylinder) 132 into which the pyrolized coal 3 in the hopper 131 is supplied from one end side (base end side) and in which cooling water 18 is showered; an outer tube (jacket) 133 which is fixedly supported to cover an outer peripheral surface of the inner tube 132 while allowing the inner tube 132 to rotate; and a chute 134 which is connected to the other end side (front end side) of the inner tube 132 to allow the inner tube 132 to rotate and which sends out the cooled pyrolized coal 3 by causing the pyrolized coal 3 to fall from the other end side (front end side) of the inner tube 132.

A lower portion of the chute 134 of the cooling device 130 communicates with an upstream side, in the conveying direction, of a pyrolized coal conveying line 139 such as a belt conveyer configured to convey the pyrolized coal 3 sent out from the chute 134. A downstream side of the pyrolized coal conveying line 139 in the conveying direction communicates with an upper portion of a device main body (processing tower) 141 of a coal deactivation processing device 140 which is deactivation processing means for performing deactivation processing on the pyrolized coal 3.

As shown in FIGS. 1 and 2, the coal deactivation processing device 140 includes: the device main body (processing tower) 141 in which the pyrolized coal 3 from the pyrolized coal conveying line 139 flows from an upper side being one side to a lower side being another side; introduction pipes 142 whose front end sides are disposed in the device main body 141 and which introduce processing gas 31 containing oxygen into the device main body 141; discharge pipes 143 whose base end sides are disposed in the device main body 141 and which discharge used processing gas 33 flowing inside the device main body 141 and used for the deactivation processing of the pyrolized coal 3 in the device main body 141; a feed pipe 144 which is connected to base end sides of the introduction pipes 142 and which has a blower 144*a* configured to feed the processing gas 31 to the introduction pipes 142; an air supply pipe 145 which is connected to a base end side of the feed pipe 144 and which supplies the air 15 to the feed pipe 144; a nitrogen supply pipe 146 which is connected to the base end side of the feed pipe 144 and which supplies nitrogen gas 27 to the feed pipe 144. Note that the front end sides of multiple introduction pipes 142 and the base end sides of multiple discharge pipes 143 are connected to the device main body 141 in a manner arranged in an up-down direction.

Front end sides of the discharge pipes 143 are connected to a base end side of a circulation pipe 148. A front end side of the circulation pipe 148 is connected to the base end side of the feed pipe 144. A humidity-temperature adjustment device 144*b* configured to adjust the humidity and temperature of the processing gas 31 to be fed to the introduction pipes 142 is provided between the front end side of the feed pipe 144 and the blower 144*a*. A flow-rate regulating valve 145*a* is provided in the middle of the air supply pipe 145, and a flow-rate regulating valve 146*a* is provided in the middle of the nitrogen supply pipe 146. A base end side of the nitrogen supply pipe 146 is connected to a nitrogen supply source 147 such as a nitrogen gas tank. One end side (base end side) of an extraction pipe 172 for extracting part of the processing gas 31 from the feed pipe 144 and feeding the processing gas 31 to a device main body 171 of a carbon monoxide processing device 170 is connected to the feed pipe 144 between the blower 144*a* and the humidity-temperature adjustment device 144*b*.

The carbon monoxide processing device 170 includes: the device main body 171 to which the other end side (front end side) of the extraction pipe 172 is connected; a fuel supply pipe 173 whose one end side (front end side) is connected to the device main body 171 and which supplies fuel 28 into the device main body 171; an air supply pipe 174 whose one end side (front end side) is connected to the device main body 171 and which supplies the air 15 into the device main body 171; a discharge pipe 175 whose base end side is connected to the device main body 171 and which discharges carbon monoxide concentration adjusted processing gas 32 subjected to carbon monoxide concentration adjustment in the device main body 141; a feed pipe 176 whose base end side is connected to the discharge pipe 175 and whose front end side is connected to the feed pipe 144 between a connection portion with the extraction pipe 172 and the humidity-temperature adjustment device 144*b*; and an exhaust pipe 177 whose base end side is connected to the discharge pipe 175. A front end side of the exhaust pipe 177 is opened to the atmosphere. A flow-rate regulating valve 173*a* is provided in the middle of the fuel supply pipe 173, and a flow-rate regulating valve 174*a* is provided in the middle of the air supply pipe 174.

As the device main body 171 of the carbon monoxide processing device 170, there may be used a device which has a function of oxidizing carbon monoxide in the processing gas 31 by processing the processing gas 31 with the fuel 28 and the air 15, for example, a device having a function of oxidizing CO such as a combustion furnace and a regenerative thermal oxidizer (RTO). Moreover, instead of the device main body 171 there may be used a catalyst which promotes oxidation reaction of carbon monoxide in the processing gas 31 due to contact with the air 15, for example, a hopcalite-based CO oxidation catalyst such as $CuMn_2O_4$ and CuZnO, a noble metal-easily reducible oxide-based CO catalyst such as $Pt/SnO_2$ and $Pd/CeO_2$, a gold nanoparticle-based CO oxidation catalyst such as $Au/TiO_2$ and $Au/Fe_2O_2$, and like.

A lower portion of the device main body 141 of the coal deactivation processing device 140 communicates with a kneading device 151 which is kneading means for mixing upgraded coal 4 subjected to the deactivation processing with binder 5 such as starch and water 6. The kneading device 151 communicates with a compression device 152 which is compressing means for compressing and molding the upgraded coal 4 kneaded and mixed with the binder 5 and the water 6 into coal briquettes 7.

One end side (base end side) of an exhaust gas line 161 having an exhaust blower 161*a* configured to discharge exhaust gas 17*a* of the heating gas 17 from the inside of the outer tube 123 is connected to the outer tube 123 of the coal pyrolizing device 120. A condenser 161*b* configured to cool the exhaust gas 17*a* is provided in the exhaust gas line 161.

The other end side (front end side) of the exhaust gas line 161 communicates with a gas receiving portion of a denitration device 162 which is denitration means for spraying ammonium chloride solution 21 on the exhaust gas 17*a*. A gas delivery portion of the denitration device 162 communicates with a gas receiving portion of an electrostatic precipitator 163 which is dust removal means for separating and removing dust and the like in the exhaust gas 17*a*. A gas delivery portion of the electrostatic precipitator 163 communicates with a gas receiving portion of a desulfurization device 164 which is desulfurization means for blowing calcium carbonate slurry 22 on the exhaust gas 17*a*. A gas delivery portion of the desulfurization device 164 communicates with the outside of the system.

In the embodiment described above, the coal drying device 110 which is the coal drying means is formed of the hopper 111, the inner tube 112, the outer tube 113, the chute 114, the inert gas feed line 115, the exhaust line 116, the cyclone separator 117, the circulation line 118, the dry coal conveying line 119, and the like; the coal pyrolizing device 120 which is coal pyrolizing means is formed of the hopper 121, the inner tube 122, the outer tube 123, the chute 124, the heating gas feed line 125, the exhaust line 126, the combustion furnace 127, the take-out line 128, and the like; pyrolysis gas discharging means is formed of the exhaust line 126 and the like; the cooling device 130 which is the pyrolized coal cooling means is formed of the hopper 131, the inner tube 132, the outer tube 133, the chute 134, the pyrolized coal conveying line 139, and the like; the coal deactivation processing device 140 is formed of the device main body 141, the introduction pipes 142, the discharge pipes 143, the feed pipe 144, the blower 144*a*, the humidity-temperature adjustment device 144*b*, the air supply pipe 145, the nitrogen supply pipe 146, the flow-rate regulating valves 145*a*, 146*a*, the nitrogen supply source 147, the circulation pipe 148, the carbon monoxide processing device 170, and the like; processing gas feeding means is formed of the introduction pipes 142, the discharge pipes 143, the feed pipe 144, the blower 144*a*, the humidity-temperature adjustment device 144*b*, the air supply pipe 145, the nitrogen supply pipe 146, the flow-rate regulating valves 145*a*, 146*a*, the nitrogen supply source 147, the circulation pipe 148, and the like; processing gas circulating means is formed of the discharge pipes 143, the circulation pipe 148, and the like; a coal briquette producing device 150 which is coal briquette producing means is formed of the kneading device 151, the compression device 152, and the like; an exhaust gas processing device 160 which is exhaust gas processing means is formed of the exhaust gas line 161, the denitration device 162, the electrostatic precipitator 163, the desulfurization device 164, and the like; the carbon monoxide processing device 170 which is carbon monoxide processing means is formed of the device main body 171, the extraction pipe 172, the fuel supply pipe 173, the air supply pipe 174, the flow-rate regulating valves 173*a*, 174*a*, the discharge pipe 175, the feed pipe 176, the exhaust pipe 177, and the like; processing gas extracting means is formed of the extraction pipe 172 and the like; oxidizing means is formed of the device main body 171, the fuel supply pipe 173, the air supply pipe 174, the flow-rate regulating valves 173*a*, 174*a*, and the like; carbon monoxide adjusted processing gas feeding means is formed of the discharge pipe 175, the feed pipe 176, and the like; and upgraded coal production equipment 100 is formed of the coal drying device 110, the coal pyrolizing device 120, the cooling device 130, the coal deactivation processing device 140, the coal briquette producing device 150, the exhaust gas processing device 160, the carbon monoxide processing device 170, and the like.

Next, main operations of the aforementioned upgraded coal production equipment 100 are described.

The steam 11 is supplied into the outer tube (jacket) 113 of the coal drying device 110, the low-rank coal 1 (average particle diameter: about 10 mm) is put into the hopper 111 to be supplied into the inner tube (main body cylinder) 112, and the inert gas 12 is fed into the inner tube 112. Then, the low-rank coal 1 moves from the one end side to the other end side of the inner tube 112 while being agitated with rotation of the inner tube 112, and is thereby thoroughly heated and dried (about 150 to 200° C.) to become the dry coal 2 (average particle diameter: about 5 mm). Thereafter, the dry coal 2 is delivered to the dry coal conveying line 119 via the chute 114 and is supplied into the hopper 121 of the coal pyrolizing device 120.

The inert gas 12 (about 150 to 200° C.) fed into the inner tube 112 of the coal drying device 110 is fed from the upper portion of the chute 114 to the cyclone separator 117 through the exhaust line 116, together with the fine coal 2*a* (particle diameter: equal to or less than 100 μm) and water vapor which are generated in the drying of the low-rank coal 1, and the fine coal 2*a* is removed from the inert gas 12. Then, the inert gas 12 is fed to the circulation line 118 and cooled by the condenser 118*a* to separate and remove the water 13. Thereafter, most (about 85%) of the inert gas 12 is returned to the inert gas feed line 115 and is fed again into the inner tube 112 together with the new inert gas 12 to be reused. Meanwhile, part (about 15%) of the inert gas 12 is fed to the combustion furnace 127 of the coal pyrolizing device 120 through the take-out line 128.

The dry coal 2 (about 150 to 200° C.) supplied to the hopper 121 of the coal pyrolizing device 120 is fed into the inner tube (main body cylinder) 122, and moves from the one end side to the other end side of the inner tube 122 while being agitated with rotation of the inner tube 122. The dry coal 2 is thereby thoroughly heated and pyrolized (350 to 450° C.) by the heating gas 17 (about 1000 to 1100° C.) to become the pyrolized coal 3 (average particle diameter: about 5 mm), the heating gas 17 fed from the combustion furnace 127 to the outer tube (jacket) 123 through the heating gas feed line 125. Then, the pyrolized coal 3 is supplied into the hopper 131 of the cooling device 130 via the chute 124.

The pyrolysis gas 14 (350 to 450° C.) generated in the pyrolysis performed in the inner tube 122 of the coal pyrolizing device 120 is fed from the upper portion of the chute 124 to the combustion furnace 127 through the exhaust line 126, and is combusted together with the inert gas 12 (containing carbon monoxide and the like) and the air 15 (and also with the combustion aid 16 as needed) to be reused for the generation of the heating gas 17.

The pyrolized coal 3 (350 to 450° C.) supplied to the hopper 131 of the cooling device 130 is fed into the inner tube (main body cylinder) 132, and moves from the one side to the other side of the inner tube 132 while being agitated with rotation of the inner tube 132. The pyrolized coal 3 is thus thoroughly cooled (about 50 to 60° C.) by the cooling water 18 showered in the inner tube 132. Then, the pyrolized coal 3 is delivered to the pyrolized coal conveying line 139 via the chute 134 and is fed into the device main body 141 of the coal deactivation processing device 140 from above.

The cooling water 18 showered in the inner tube 132 of the cooling device 130 is vaporized in the cooling of the pyrolized coal 3, and is sent to the outside of the system from the upper portion of the chute 134 as water vapor 20.

The pyrolized coal 3 (about 50 to 60° C.) supplied from the upper portion of the device main body 141 of the coal deactivation processing device 140 is subjected to the deactivation processing in the following way. The air 15 and the nitrogen gas 27 are fed to the feed pipe 144 from the supply pipes 145, 146 by controlling opening degrees of the flow-rate regulating valves 145*a*, 146*a* and an operation of the blower 144*a* and are mixed to produce the processing gas 31, and active coal (radial) generated in the pyrolysis reacts with oxygen in the processing gas 31 whose humidity and temperature are adjusted by controlling an operation of the humidity-temperature adjustment device 144*b*. The pyrolized coal 3 thus becomes the upgraded coal 4 (average particle diameter: about 5 mm) and is fed from the lower portion of the device main body 141 to the kneading device 151.

The processing gas (about 50 to 70° C.) 33 used for the deactivation processing of the pyrolized coal 3 in the device main body 141 of the coal deactivation processing device 140 is discharged from the inside of the device main body 141 through the discharge pipes 143 and is returned to the feed pipe 144 via the circulation pipe 148. Then, the processing gas 33 is mixed with the new air 15 and nitrogen gas 27 from the supply pipes 145, 146 and is reused as the new processing gas 31.

The upgraded coal 4 (about 30° C.) fed to the kneading device 151 is kneaded and mixed with the binder 5 and the water 6. Thereafter, the upgraded coal 4 is fed to the compression device 152 to be compressed and molded and is produced into the coal briquettes 7.

In a case of producing the coal briquettes 7 from the low-rank coal 1 as described above, carbon monoxide gas is generated in the deactivation processing of the pyrolized coal 3.

Since the coal deactivation processing device 140 like one described above includes the circulation pipe 148 connected to the discharge pipes 143 and the feed pipe 144, the used processing gas 33 contains the carbon monoxide gas generated in the deactivation processing of the pyrolized coal 3 in the device main body 141. Accordingly, in the conventional technique, the carbon monoxide concentration in the processing gas may increase with the elapse of operation time.

In the upgraded coal production equipment 100 of the embodiment made in view of such a problem, the following operation is performed to suppress the increase of carbon monoxide concentration in the processing gas.

Part of the processing gas 31 to be fed to the introduction pipes 142 by controlling the operation of the blower 144*a* is extracted by the extraction pipe 172 and is fed into the device main body 171 of the carbon monoxide processing device 170 through the extraction pipe 172. The processing gas 31 is then combusted together with the air 15 which is fed into the device main body 171 of the carbon monoxide processing device 170 through the air supply pipe 174 by controlling the opening degree of the flow-rate regulating valve 174*a* (also with the fuel 28 as necessary, the fuel 28 being oil (for example, fuel oil, kerosene, or the like) which is fed into the device main body 171 of the carbon monoxide processing device 170 through the fuel supply pipe 173 by controlling the opening degree of the flow-rate regulating valve 173*a*). The carbon monoxide in the processing gas 31 is thus oxidized, and the processing gas 31 is turned into the carbon monoxide concentration adjusted processing gas 32 produced by reducing the carbon monoxide concentration in the processing gas 31. The carbon monoxide concentration adjusted processing gas 32 is discharged from the inside of the device main body 171 by the discharge pipe 175 to be fed to the feed pipe 144 through the feed pipe 176 and exhausted to the outside of the system through the exhaust pipe 177 as necessary.

Due to this configuration, although the used processing gas 33 discharged from the discharge pipes 143 of the coal deactivation processing device 140 is returned to the feed pipe 144 by the circulation pipe 148, the device main body 171 of the carbon monoxide processing device 170 turns part of the processing gas 31 to be fed to the introduction pipes 142 by the blower 144*a* into the carbon monoxide concentration adjusted processing gas 32 by reducing the carbon monoxide concentration in the processing gas 31, and part of the carbon monoxide concentration adjusted processing gas 32 is returned to the feed pipe 144 and is fed to the introduction pipes 142. Hence, it is possible to suppress the increase of the carbon monoxide concentration of the processing gas 31 fed by the blower 144*a* and introduced into the device main body 141 through the introduction pipes 142.

Accordingly, in the embodiment, even when the used processing gas 33 used in and discharged from the device main body 141 is returned to the feed pipe 144 by the circulation pipe 148, it is possible to suppress the increase of the carbon monoxide concentration in the processing gas 31 to be introduced into the device main body 141 through the introduction pipes 142. Due to this, even when the coal deactivation processing device 140 is installed in a building which is a closed space, the increase of the carbon monoxide concentration in the building can be suppressed. Hence, a safe environment can be maintained even in the building.

Second Embodiment

Figure 3:
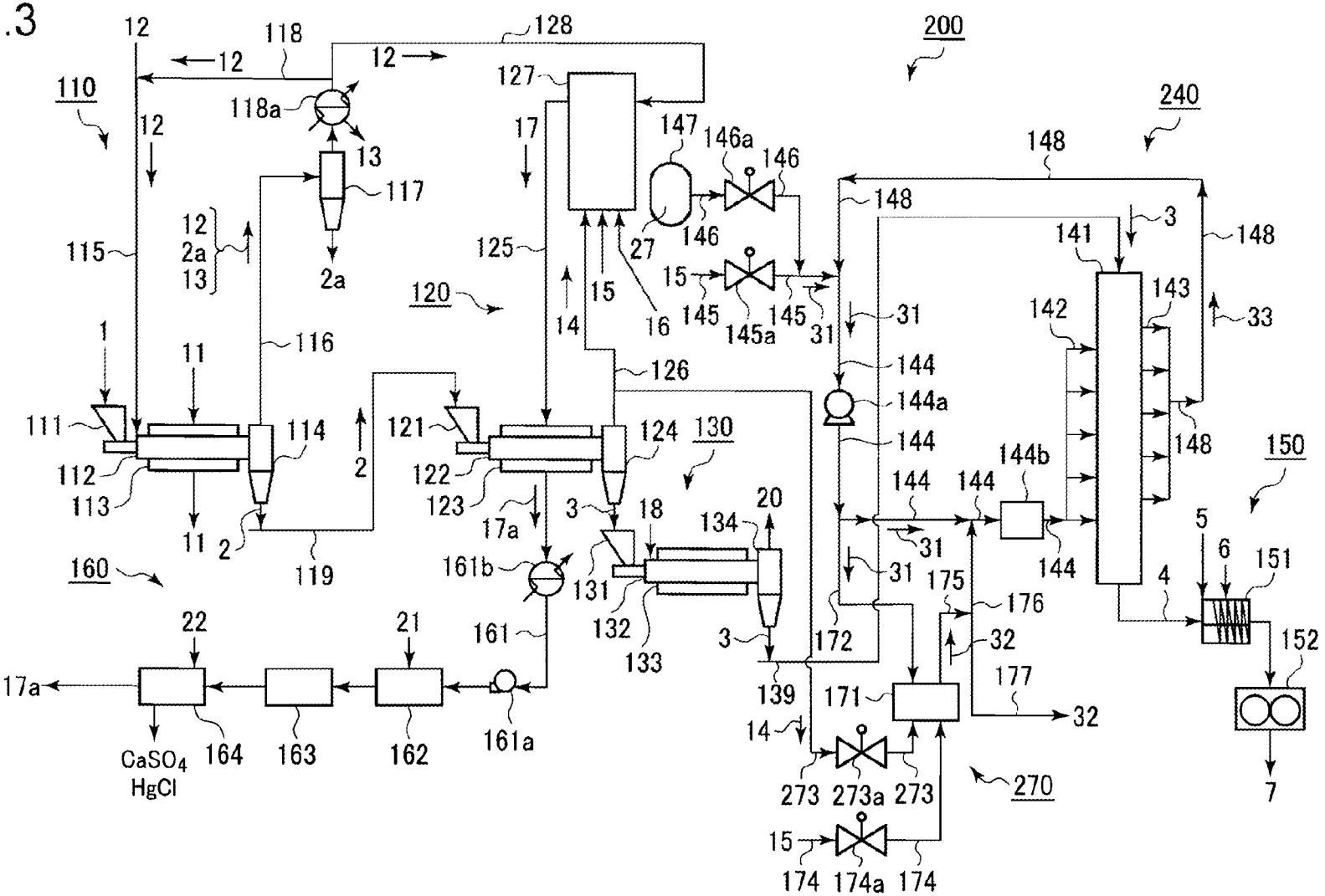
FIG. 3 is a schematic configuration diagram of a second embodiment of the upgraded coal production equipment in the present invention.

A second embodiment of the coal deactivation processing device and the upgraded coal production equipment using the same in the present invention is described based on FIG. 3.

The embodiment has a configuration in which the fuel supply pipe configured to supply the fuel to the carbon monoxide processing device included in the aforementioned first embodiment shown in FIG. 1 is changed. Other configurations are substantially the same as those described above and shown in FIG. 1. The same devices are denoted by the same reference numerals and overlapping description is omitted as appropriate.

As shown in FIG. 3, a coal deactivation processing device 240 of the embodiment includes a carbon monoxide processing device 270 having a fuel supply pipe 273 whose one end side (front end side is connected to the device main body 171 and which supplies the pyrolysis gas 14 into the device main body 171 as fuel. A base end side of the fuel supply pipe 273 is connected to the exhaust line 126 between the front end side and the base end side thereof, the exhaust line 126 used to discharge the pyrolysis gas 14 discharged from the inside of the inner tube 122 of the pyrolizing device 120 to the combustion furnace 127. Part of the pyrolysis gas 14 discharged from the inside of the inner tube 122 is thereby fed to the fuel supply pipe 273. A flow-rate regulating valve 273*a* is provided in the middle of the fuel supply pipe 273.

Note that, in the embodiment, the coal deactivation processing device 240 is formed of the device main body 141, the introduction pipes 142, the discharge pipes 143, the feed pipe 144, the blower 144*a*, the humidity-temperature adjustment device 144*b*, the air supply pipe 145, the nitrogen supply pipe 146, the flow-rate regulating valves 145*a*, 146*a*, the nitrogen supply source 147, the circulation pipe 148, the carbon monoxide processing device 270, and the like; the carbon monoxide processing device 270 which is the carbon monoxide processing means is formed of the device main body 171, the extraction pipe 172, the fuel supply pipe 273, the air supply pipe 174, the flow-rate regulating valves 273*a*, 174*a*, the discharge pipe 175, the feed pipe 176, the exhaust pipe 177, and the like; fuel feeding means is formed of the fuel supply pipe 273, the flow-rate regulating valve 273*a*, and the like; and upgraded coal production equipment 200 is formed of the coal drying device 110, the coal pyrolizing device 120, the cooling device 130, the coal deactivation processing device 240, the coal briquette producing device 150, the exhaust gas processing device 160, the carbon monoxide processing device 270, and the like.

The upgraded coal production equipment 200 of the embodiment including the fuel supply pipe 273 and the flow-rate regulating valve 273*a* as described above can produce the coal briquettes 7 from the low-rank coal 1 by performing main operations as in the aforementioned upgraded coal production equipment 100 of the first embodiment.

Moreover, the pyrolysis gas 14 discharged from the inner tube 122 of the pyrolizing device 120 can be fed into the device main body 171 of the carbon monoxide processing device 270 through the exhaust line 126 and the fuel supply pipe 273 by controlling an opening degree of the flow-rate regulating valve 273*a* and the operation of the blower 144*a*.

Thus, there is no need to additionally provide a fuel supply source configured to supply fuel to the device main body 171, and the running cost can be reduced.

Accordingly, in the embodiment, as in the aforementioned embodiment, the increase of the carbon monoxide concentration in the processing gas 31 introduced into the device main body 141 by the introduction pipes 142 can be suppressed even when the used processing gas 33 used in and discharged from the device main body 141 is returned to the feed pipe 144 by the circulation pipe 148. Due to this, even when the coal deactivation processing device 240 is installed in a building which is a closed space, the increase of the carbon monoxide concentration in the building can be suppressed. Hence, a safe environment can be maintained even in the building. Furthermore, since there is no need to additionally provide a supply source for fuel to be supplied to the device main body 171 of the carbon monoxide processing device 270, cost for processing carbon monoxide due to installation of the fuel supply source and the fuel of the fuel supply source can be suppressed.

Third Embodiment

A third embodiment of the coal deactivation processing device and the upgraded coal production equipment using the same in the present invention is described based on FIGS. 4 to 7.

The embodiment has a configuration in which an extraction amount regulating valve being a flow-rate regulating valve is added to the extraction pipe included in the aforementioned first embodiment shown in FIG. 2. Other configurations are substantially the same as those described above and shown in FIG. 2. The same devices are denoted by the same reference numerals and overlapping description is omitted as appropriate.

Figure 4:
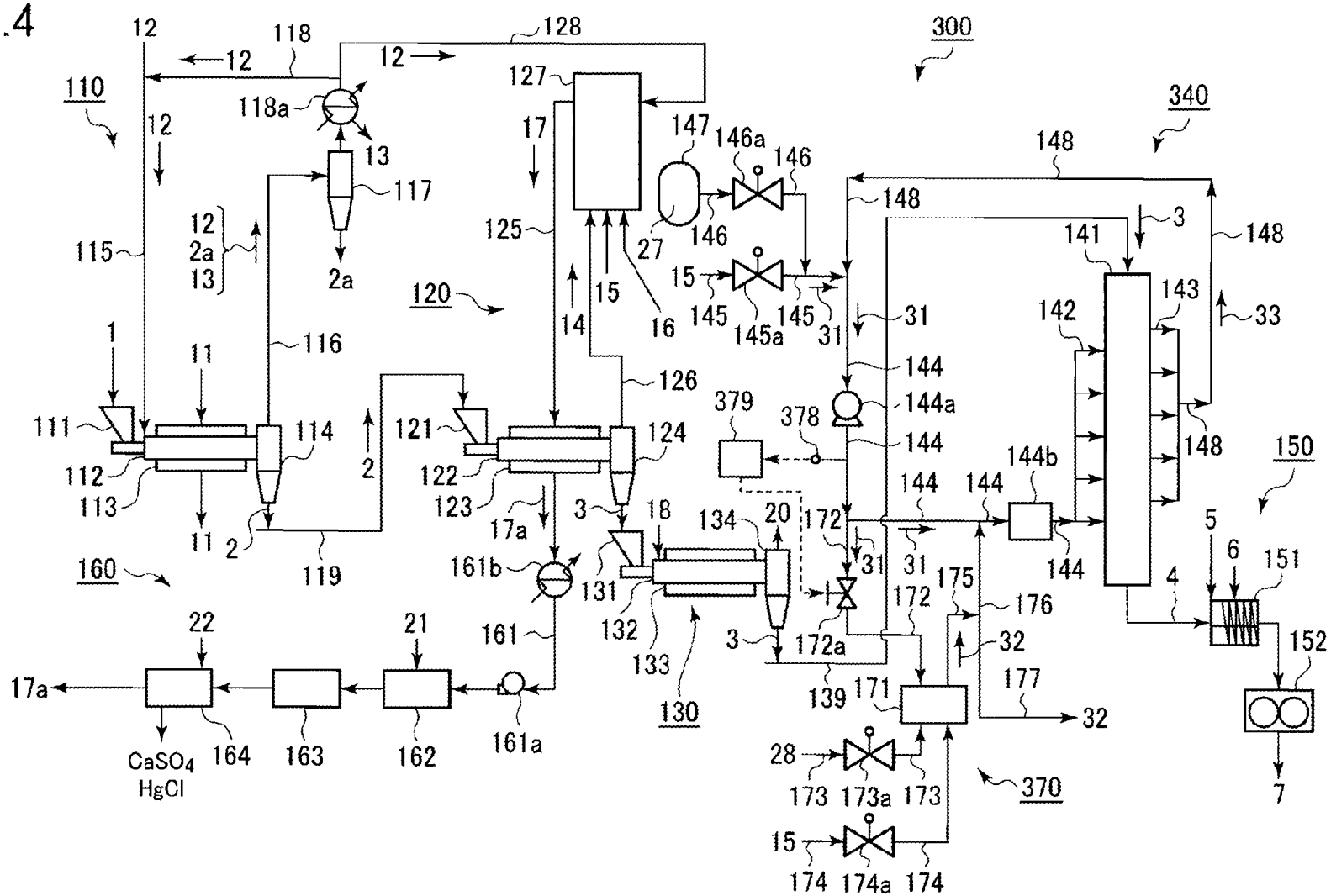
FIG. 4 is a schematic configuration diagram of a third embodiment of the upgraded coal production equipment in the present invention.
Figure 5:
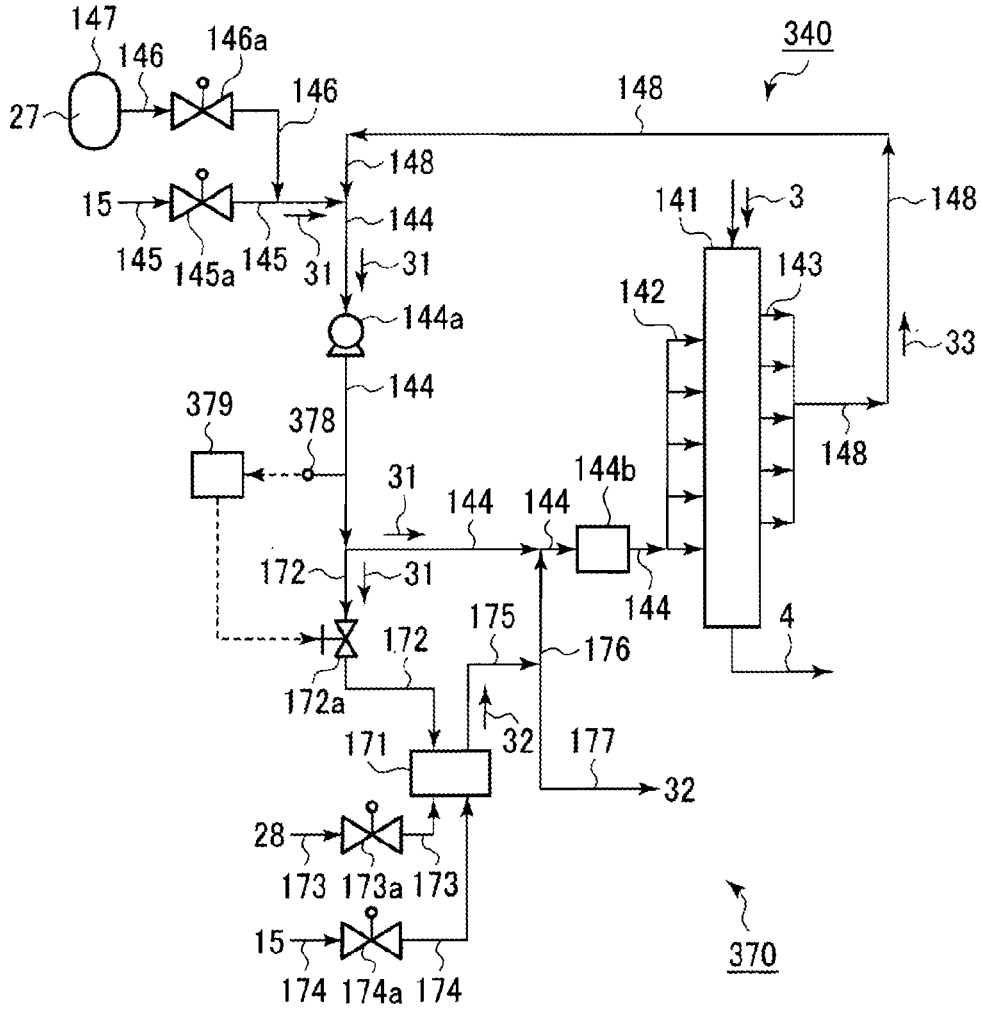
FIG. 5 is a schematic configuration diagram of a main portion of a coal deactivation processing device in FIG. 4.

As shown in FIGS. 4 and 5, an extraction amount regulating valve 172*a* configured to regulate an extraction amount is provided between the one end side (front end side) and the other end side (base end side) of the extraction pipe 172. A carbon monoxide sensor 378 which is processing gas state detecting means for detecting the carbon monoxide concentration of the processing gas 31 flowing in the feed pipe 144 is provided in the feed pipe 144 between the connection portion with the extraction pipe 172 and the blower 144*a*.

Furthermore, a coal deactivation processing device 340 of the embodiment includes a control device 379 whose output side is electrically connected to the extraction amount regulating valve 172*a* in addition to the blower 144*a*, the humidity-temperature adjustment device 144*b*, the flow-rate regulating valves 145*a*, 146*a*, and the flow-rate regulating valves 173*a*, 174*a*. The carbon monoxide sensor 378 is electrically connected to an input side of the control device 379. The control device 379 can control the extraction amount regulating valve 172*a* in addition to the blower 144*a*, the humidity-temperature adjustment device 144*b*, the flow-rate regulating valves 145*a*, 146*a*, and the flow-rate regulating valves 173*a*, 174*a*, on basis of information from the carbon monoxide sensor 378 and the like.

Note that, in the embodiment, the coal deactivation processing device 340 is formed of the device main body 141, the introduction pipes 142, the discharge pipes 143, the feed pipe 144, the blower 144*a*, the humidity-temperature adjustment device 144*b*, the air supply pipe 145, the nitrogen supply pipe 146, the flow-rate regulating valves 145*a*, 146*a*, the nitrogen supply source 147, the circulation pipe 148, a carbon monoxide processing device 370, and the like; the carbon monoxide processing device 370 which is the carbon monoxide processing means is formed of the device main body 171, the extraction pipe 172, the extraction amount regulating valve 172*a*, the fuel supply pipe 173, the air supply pipe 174, the flow-rate regulating valves 173*a*, 174*a*, the discharge pipe 175, the feed pipe 176, the exhaust pipe 177, the carbon monoxide sensor 378, the control device 379, and the like; extraction amount regulating means is formed of the extraction amount regulating valve 172*a* and the like; the processing gas state detecting means is formed of the carbon monoxide sensor 378 and the like; control means is formed the control device 379 and the like; and upgraded coal production equipment 300 is formed of the coal drying device 110, the coal pyrolizing device 120, the cooling device 130, the coal deactivation processing device 340, the coal briquette producing device 150, the exhaust gas processing device 160, the carbon monoxide processing device 370, and the like.

The upgraded coal production equipment 300 of the embodiment including the extraction amount regulating valve 172*a*, the carbon monoxide sensor 378, and the control device 379 as described above can produce the coal briquettes 7 from the low-rank coal 1 by performing main operations as in the aforementioned upgraded coal production equipment 100 of the first embodiment.

Moreover, the control device 379 can regulate the extraction amount of the processing gas 31 to be fed into the device main body 171 of the carbon monoxide processing device 370 through the extraction pipe 172 by controlling the opening degree of the extraction amount regulating valve 172*a* on the basis of information on the carbon monoxide concentration in the processing gas 31 detected by the carbon monoxide sensor 378 provided in the feed pipe 144 between the connection portion with the extraction pipe 172 and the blower 144*a*. Accordingly, it is possible to set the extraction amount regulating valve 172*a* to an opened state by controlling the extraction amount regulating valve 172*a* such that part of the processing gas 31 is extracted from the feed pipe 144 by the extraction pipe 172 when the carbon monoxide concentration in the processing gas 31 is greater than, for example, an upper limit value (first predetermined value) X1, and to set the extraction amount regulating valve 172*a* to a fully-closed state by controlling the extraction amount regulating valve 172*a* such that no processing gas 31 is extracted from the feed pipe 144 by the extraction pipe 172 when the carbon monoxide concentration of the processing gas 31 is less than, for example, a lower limit value (second predetermined value) X2. In other words, the carbon monoxide concentration of the processing gas 31 to be fed into the device main body 141 by the introduction pipes 142 can be adjusted to be within a predetermined range.

The upper limit value X1 and the lower limit value X2 are, for example, values complying with the Ordinance on Health Standards in the Office based on the Industrial Safety and Health Act, and can be set to 50 ppm and 10 ppm, respectively.

Figure 6:
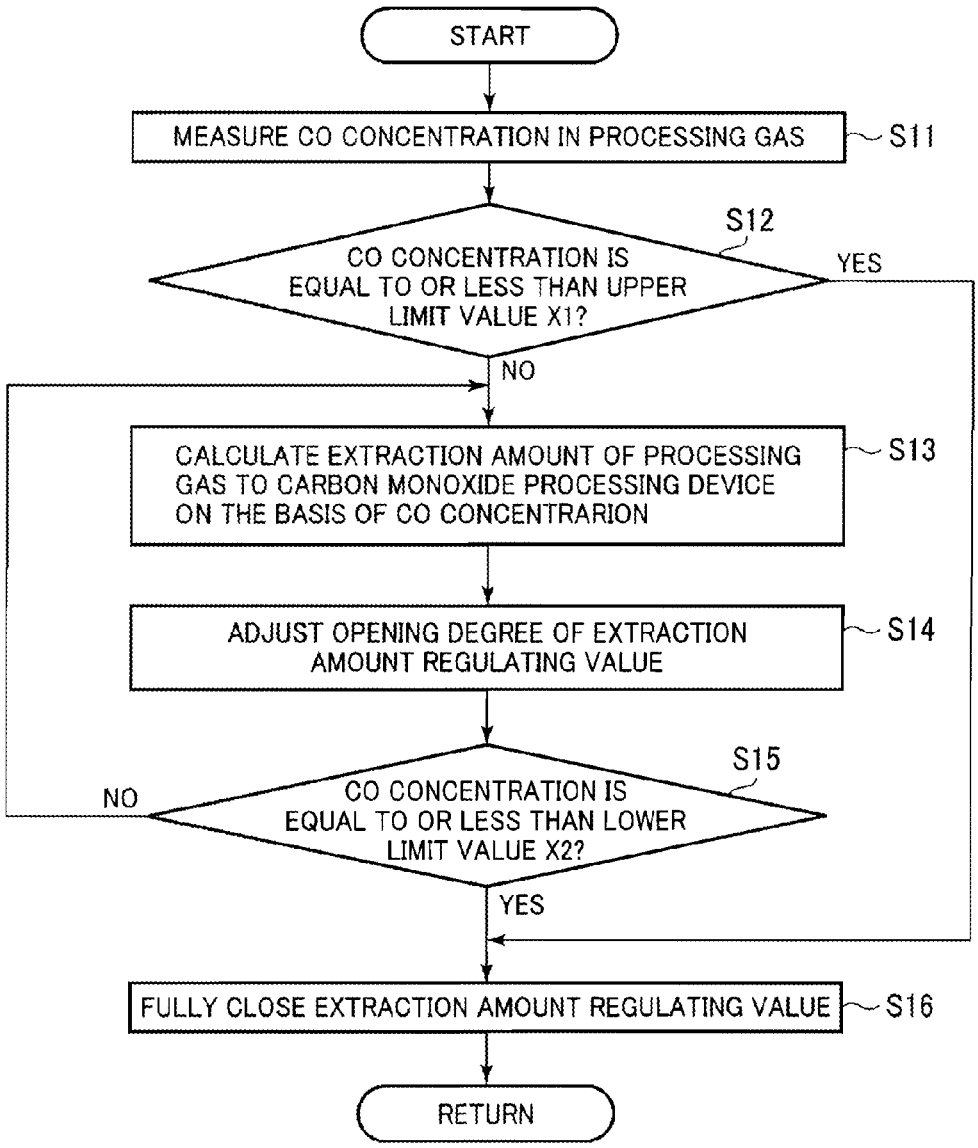
FIG. 6 is a flowchart showing a control flow of the coal deactivation processing device.
Figure 7:
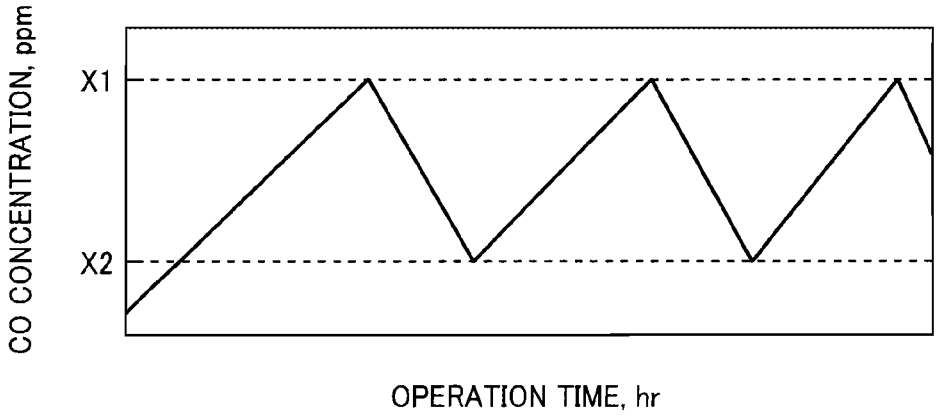
FIG. 7 is a graph showing an example of history of CO concentration in processing gas in the coal deactivation processing device.
Figure 8:
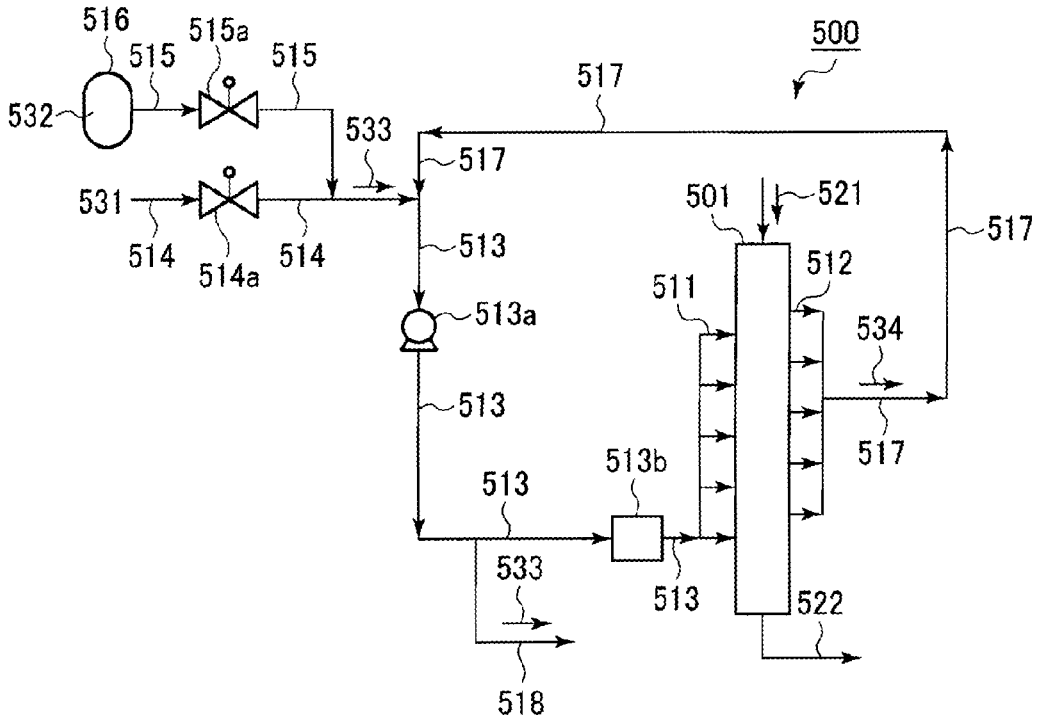
FIG. 8 is a schematic configuration diagram of a conventional coal deactivation processing device.

An example of control of the extraction amount regulating valve 172*a* by the control device 379 is described with reference to FIGS. 6 and 7.

When an operation of the upgraded coal production equipment 300 is started, the carbon monoxide sensor 378 continuously detects the carbon monoxide concentration of the processing gas 31 fed into the feed pipe 144 by the blower 144*a* (first step S11). A measurement value which is the information on the carbon monoxide concentration detected by the carbon monoxide sensor 378 is sent to the control device 379.

Next, the control device 379 determines whether the measurement value is equal to or less than the upper limit value X1 on the basis of the information from the carbon monoxide sensor 378 (second step S12). When the measurement value is equal to or less than the upper limit value X1, the processing proceeds to a sixth step S16 described in detail later. Meanwhile, when the measurement value is greater than the upper limit value X1, the control device 379 calculates the extraction amount to the device main body 171 of the carbon monoxide processing device 370, i.e. the amount of part of the processing gas 31 to be extracted from the feed pipe 144 by the extraction pipe 172, on the basis of the measurement value (third step S13).

Then, the control device 379 adjusts the opening degree of the extraction amount regulating valve 172*a* by controlling the extraction amount regulating valve 172*a* on the basis of a calculation result obtained in the third step S13 (fourth step S14).

Next, the control device 379 determines whether the measurement value is equal to or less than the lower limit X2 on the basis of the information from the carbon monoxide sensor 378 (fifth step S15). When the measurement value is equal to or less than the lower limit value X2, the processing proceeds to the sixth step S16 described in detail later. Meanwhile, when the measurement value is greater than the lower limit value X2, the processing returns to the third step S13. Then, the control device 379 calculates the amount of part of the processing gas 31 to be extracted from the feed pipe 144 by the extraction pipe 172 on the basis of the measurement value (third step S13), adjusts the opening degree of the extraction amount regulating valve by controlling the extraction amount regulating valve 172*a* (fourth step S14), and then determines whether the measurement value is equal to or less than the lower limit value X2 on basis of the measurement value.

Then, when the measurement value is equal to or less than the lower limit value X2, the control device 379 controls the extraction amount regulating valve 172*a* such that no processing gas 31 is extracted from the feed pipe 144 by the extraction pipe 172, and fully closes the extraction amount regulating valve 172*a* (sixth step S16).

Such processing is continuously performed until the operation of the upgraded coal production equipment 300 is stopped. The carbon monoxide concentration in the processing gas 31 detected by the carbon monoxide sensor 378 thus fluctuates between the upper limit value X1 and the lower limit value X2 as shown in FIG. 7.

Accordingly, in the embodiment, even when the used processing gas 33 used in and discharged from the device main body 141 is returned to the feed pipe 144 by the circulation pipe 148, the increase of the carbon monoxide concentration in the processing gas 31 to be fed into the device main body 141 by the introduction pipes 142 can be surely suppressed by controlling the extraction amount regulating valve 172*a* on the basis of the information on the carbon monoxide concentration in the processing gas 31 detected by the carbon monoxide sensor 378. Due to this, even when the coal deactivation processing device 340 is installed in a building which is a closed space, the increase of the carbon monoxide concentration in the building can be suppressed. Accordingly, a safe environment can be maintained even in the building.

Other Embodiments

Note that it is possible to apply features of the upgraded coal production equipment 300 to the upgraded coal production equipment 200 and form upgraded coal production equipment including the carbon monoxide sensor 378 provided in the feed pipe 144, the extraction amount regulating valve 172*a* provided in the extraction pipe 172, and the control device 379 configured to control the extraction amount regulating valve 172*a* on the basis of information on the carbon monoxide concentration detected by the carbon monoxide sensor 378. Operations and effects similar to those of the upgraded coal production equipment 300 can be obtained also in such upgraded coal production equipment.

In above description, description is given by using the coal deactivation processing device 340 including the control device 379 configured to perform such control that the carbon monoxide concentration in the processing gas 31 fluctuates between the upper limit value X1 and the lower limit value X2. However, it is possible to use a coal deactivation processing device including a control device configured perform such control that the carbon monoxide concentration in the processing gas is equal to or less than the upper limit value X1.

In the above description, description is given by using the coal deactivation processing devices 140, 240, 340 in which part of the processing gas 31 is extracted from the feed pipe 144 by the extraction pipe 172 and fed to the device main body 171 to be turned into the carbon monoxide concentration adjusted processing gas 32 produced by reducing the carbon monoxide concentration of the processing gas 31 in the device main body 171, and the carbon monoxide concentration adjusted processing gas 32 is returned to the feed pipe 144 by the discharge pipe 175 and the feed pipe 176. However, it is possible to use a coal deactivation processing device configured such that part of the processing gas 31 or the used processing gas 33 is extracted and turned into the carbon monoxide concentration adjusted processing gas produced by reducing the carbon monoxide concentration of the processing gas 31, 33 in the device main body 171, and the carbon monoxide concentration adjusted processing gas is returned to any of the feed pipe 144, the introduction pipes 142, the discharge pipes 143, and the circulation pipe 148.

INDUSTRIAL APPLICABILITY

Since the coal deactivation processing devices and the upgraded coal production equipments using the same in the present invention can suppress the increase of the carbon monoxide concentration in the processing gas despite of circulating and reusing the used processing gas, the coal deactivation processing devices and the upgraded coal production equipments can be very useful in industries.

EXPLANATIONS OF REFERENCE NUMERALS

1 LOW-RANK COAL (LOW-QUALITY COAL)
2 DRY COAL
2*a* FINE COAL
3 PYROLIZED COAL
4 UPGRADED COAL
5 BINDER
6 WATER
7 COAL BRIQUETTE
11 STEAM
12 INERT GAS
13 WATER
14 PYROLYSIS GAS
15 AIR
16 COMBUSTION AID
17 HEATING GAS
17*a* EXHAUST GAS
18 COOLING WATER
20 WATER VAPOR
21 AMMONIUM CHLORIDE SOLUTION
22 CALCIUM CARBONATE SLURRY
27 NITROGEN GAS
28 FUEL
31 PROCESSING GAS
32 CARBON MONOXIDE CONCENTRATION ADJUSTED PROCESSING GAS
33 USED PROCESSING GAS
100, 200, 300 UPGRADED COAL PRODUCTION EQUIPMENT
110 COAL DRYING DEVICE
111 HOPPER
112 INNER TUBE (MAIN BODY CYLINDER)
113 OUTER TUBE (JACKET)
114 CHUTE
115 INERT GAS FEED LINE
116 EXHAUST LINE
117 CYCLONE SEPARATOR
118 CIRCULATION LINE
118*a* CONDENSER
119 DRY COAL CONVEYING LINE
120 COAL PYROLIZING DEVICE
121 HOPPER
122 INNER TUBE (MAIN BODY CYLINDER)
123 OUTER TUBE (JACKET)
124 CHUTE
125 HEATING GAS FEED LINE
126 EXHAUST LINE

127 COMBUSTION FURNACE
128 TAKE-OUT LINE
130 COOLING DEVICE
131 HOPPER
132 INNER TUBE
133 OUTER TUBE
134 CHUTE
139 PYROLIZED COAL CONVEYING LINE
140 COAL DEACTIVATION PROCESSING DEVICE
141 DEVICE MAIN BODY (PROCESSING TOWER)
142 INTRODUCTION PIPE
143 DISCHARGE PIPE
144 FEED PIPE
144*a* BLOWER
144*b* HUMIDITY-TEMPERATURE ADJUSTMENT DEVICE
145 AIR SUPPLY PIPE
145*a* FLOW-RATE REGULATING VALVE
146 NITROGEN SUPPLY PIPE
146*a* FLOW-RATE REGULATING VALVE
147 NITROGEN SUPPLY SOURCE
148 CIRCULATION PIPE
150 COAL BRIQUETTE PRODUCING DEVICE
151 KNEADING DEVICE
152 COMPRESSION DEVICE
160 EXHAUST GAS PROCESSING DEVICE
161 EXHAUST GAS LINE
161*a* EXHAUST BLOWER
161*b* CONDENSER
162 DENITRATION DEVICE
163 ELECTROSTATIC PRECIPITATOR
164 DESULFURIZATION DEVICE
170 CARBON MONOXIDE PROCESSING DEVICE
171 DEVICE MAIN BODY (PROCESSING TOWER)
172 EXTRACTION PIPE
172*a* EXTRACTION AMOUNT REGULATING VALVE
173 FUEL SUPPLY PIPE
173*a* FLOW-RATE REGULATING VALVE
174 AIR SUPPLY PIPE
174*a* FLOW-RATE REGULATING VALVE
175 DISCHARGE PIPE
176 FEED PIPE
177 EXHAUST PIPE
273 FUEL SUPPLY PIPE
273*a* FLOW-RATE REGULATING VALVE
378 CARBON MONOXIDE SENSOR
379 CONTROL DEVICE
522 PROCESSED COAL

The invention claimed is:

1. A coal deactivation processing device configured to deactivate coal with processing gas containing oxygen, characterized in that the coal deactivation processing device comprises:

a device main body in which the coal flows from one side to another side;

processing gas feeding means for feeding the processing gas into the device main body;

processing gas circulating means for circulating used processing gas used in the device main body to the processing gas feeding means; and carbon monoxide processing means for adjusting a carbon monoxide concentration in the processing gas such that the carbon monoxide concentration in the processing gas is reduced, the carbon monoxide processing means including:

processing gas extracting means for extracting the processing gas;

oxidizing means for oxidizing carbon monoxide in the processing gas extracted by the processing gas extracting means and adjusting the carbon monoxide concentration in the processing gas; and carbon monoxide adjusted processing gas feeding means for feeding the processing gas whose carbon monoxide concentration is adjusted by the oxidizing means to the processing gas feeding means or the processing gas circulating means.

2. The coal deactivation processing device according to claim 1, characterized in that the oxidizing means is any one of an oxidation catalyst configured to oxidize carbon monoxide in the processing gas, a combustion furnace configured to combust the processing gas together with supplied fuel, and a regenerative thermal oxidizer configured to combust the processing gas together with supplied fuel.

3. The coal deactivation processing device according to claim 1, characterized in that the coal deactivation processing device further comprises:

extraction amount regulating means for regulating an extraction amount by which the processing gas extracting means extracts the processing gas;

processing gas state detecting means for detecting the carbon monoxide concentration of the processing gas flowing in the processing gas feeding means or the processing gas circulating means; and control means for controlling the extraction amount regulating means on the basis of the carbon monoxide concentration of the processing gas detected by the processing gas state detecting means.

4. The coal deactivation processing device according to claim 3, characterized in that the control means:

controls the extraction amount regulating means such that the processing gas is extracted by the extracting means when the carbon monoxide concentration of the processing gas detected by the processing gas state detecting means is equal to or greater than an upper limit value; and controls the extraction amount regulating means such that no processing gas is extracted by the extracting means when the carbon monoxide concentration of the processing gas detected by the processing gas state detecting means is equal to or less than a lower limit value less than the upper limit value.

5. Upgraded coal production equipment characterized in that the upgraded coal production equipment comprises:

coal drying means for drying coal;

coal pyrolizing means for pyrolizing dry coal dried by the coal drying means;

pyrolized coal cooling means for cooling pyrolized coal pyrolized by the coal pyrolizing means; and the coal deactivation processing device according to claim 1 which performs deactivation processing on the pyrolized coal cooled by the coal cooling means.

6. Upgraded coal production equipment characterized in that the upgraded coal production equipment comprises:

coal drying means for drying coal;

coal pyrolizing means for pyrolizing dry coal dried by the coal drying means;

pyrolized coal cooling means for cooling pyrolized coal pyrolized by the coal pyrolizing means; and the coal deactivation processing device according to claim 2 which performs deactivation processing on the pyrolized coal cooled by the coal cooling means, the coal pyrolizing means includes an inner tube to which the coal is supplied, an outer tube which is provided to cover the inner tube and into which heating gas is supplied to indirectly heat the inner tube, and pyrolysis gas discharging means for discharging pyrolysis gas generated by heating the coal in the inner tube, and the upgraded coal production equipment further comprises fuel feeding means for feeding the pyrolysis gas discharged by the pyrolysis gas discharging means to the combustion furnace or the regenerative thermal oxidizer.

* * * * *